US006267377B1

(12) United States Patent
Griggs

(10) Patent No.: US 6,267,377 B1
(45) Date of Patent: Jul. 31, 2001

(54) ASTRONOMY-BASED CARD GAME

(76) Inventor: Herman W. Griggs, 216 Deer La., Ellijay, GA (US) 30540

( * ) Notice: Subject to any disclaimer, the term of this patent is extended or adjusted under 35 U.S.C. 154(b) by 0 days.

(21) Appl. No.: 09/439,043

(22) Filed: Nov. 12, 1999

(51) Int. Cl.[7] ..... A63F 1/00
(52) U.S. Cl. ..... 273/292; 273/306; 273/302
(58) Field of Search ..... 273/306, 292, 273/302

(56) References Cited

U.S. PATENT DOCUMENTS

| | | | | |
|---|---|---|---|---|
| 1,139,356 | | 5/1915 | Fields . | |
| 3,223,420 | | 12/1965 | Turner | 273/134 |
| 3,973,775 | | 8/1976 | Bolan et al. | 273/134 |
| 4,090,717 | * | 5/1978 | Rossetti | 273/249 |
| 4,109,918 | * | 8/1978 | Mele et al. | 273/256 |
| 4,804,190 | | 2/1989 | Hofmann | 273/250 |
| 5,141,235 | * | 8/1992 | Hernandez | 273/308 |
| 5,690,336 | * | 11/1997 | Oliver | 273/302 |
| 5,927,719 | | 7/1999 | Young | 273/302 |

OTHER PUBLICATIONS

Internet site, Card Games Home Page, http://www.pagat.com/invented/uno_vars.html.*

* cited by examiner

*Primary Examiner*—Jeanette Chapman
*Assistant Examiner*—Zelalem Eshete
(74) *Attorney, Agent, or Firm*—Gardner Groff Mehrman & Josephic, P.C.

(57) ABSTRACT

An astronomy-based card game using a deck of cards including suits of cards representing planets of the solar system. Cards are played according to a prescribed set of rules until a player assembles a hand including cards representing a complete solar system of a single suit. Wildcards representing various astronomical bodies permit a player to play according to a non-standard protocol. Factual information regarding the various astronomical bodies provided on the cards educates the players in the field of astronomy.

4 Claims, 3 Drawing Sheets

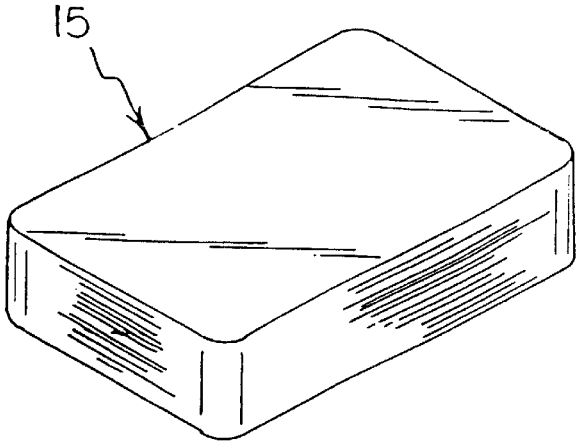
FIG 1
FIG 2
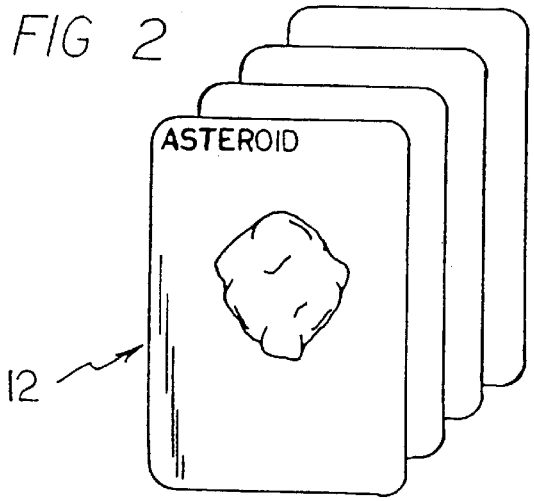
FIG 3
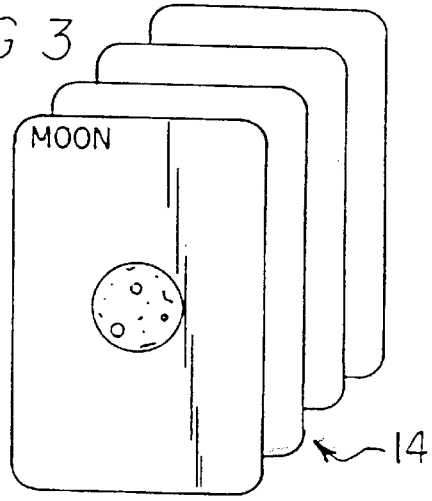
FIG 4
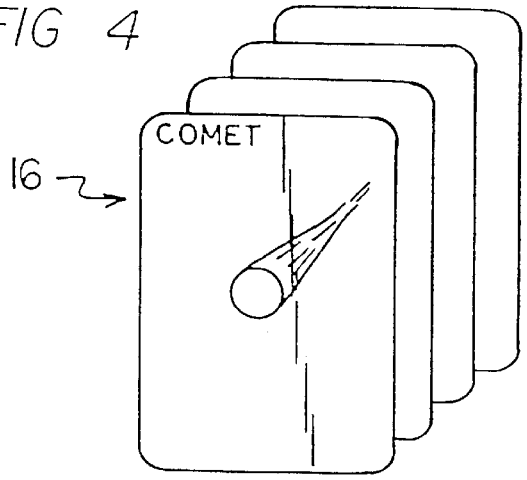
FIG 5
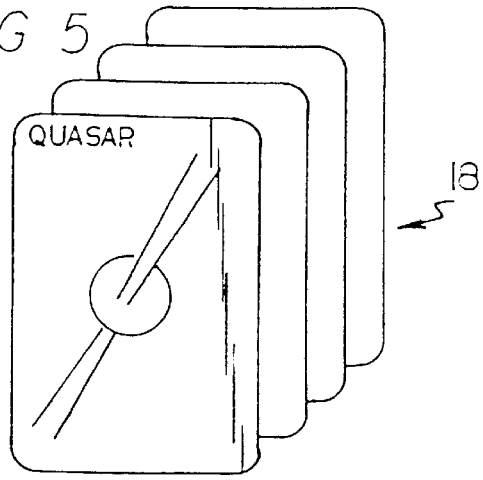

ASTRONOMY-BASED CARD GAME

SUMMARY OF THE INVENTION

A card game includes a plurality of cards representing different astronomical bodies, where some of the cards have different color suits. The object of the game is to build a hand of a single color and including a complete set of astronomical bodies representing a solar system. In accordance with the game rules, after an initial distribution, cards are drawn from piles on the table or another player's hand until a winning hand is developed which contains a set of Solar System cards of a single color.

The deck of astronomical cards includes four asteroid cards, four moon cards, four comet cards, four quasar cards, one black hole card, and ten groups of five cards each representing the Earth's Solar system. The cards representing the solar System include five Neptune cards, five Pluto cards, five Earth cards, five Venus cards, five Mercury cards, five Sun cards, five Uranus cards, five Saturn cards, five Jupiter cards, and five Mars cards. Each of the groups of Solar system cards includes one card from each of five colored suits. For example, the deck may include five colored suits of red, blue, green, orange, and yellow. Each suit includes one Sun card, one Mercury card, one Venus card, one Earth card, one Mars card, one Jupiter card, one Saturn card, one Uranus card, one Neptune card, and one Pluto card. All of the cards from a deck containing sixty-seven cards in total.

BRIEF DESCRIPTION OF THE DRAWINGS

The invention will be better understood and the above objects as well as objects other than those set forth above will become more apparent after a study of the following detailed description thereof. Such description makes reference to annexed drawings wherein:

FIG. 1 is a perspective view showing a deck of cards used in the astronomy based card game of the invention.

FIG. 2 is a perspective view of four asteroid cards used in the astronomy based card game.

FIG. 3 is a perspective view of four moon cards used in the astronomy based card game.

FIG. 4 is a perspective view of four comet cards used in the astronomy based card game.

FIG. 5 is a perspective view of four quasar cards used in the astronomy based card game.

DESCRIPTION OF THE PREFERRED EMBODIMENT

With reference to the drawings, a new and improved astronomy based card game embodying the principles and concepts of the present invention will be described.

Figure 6:
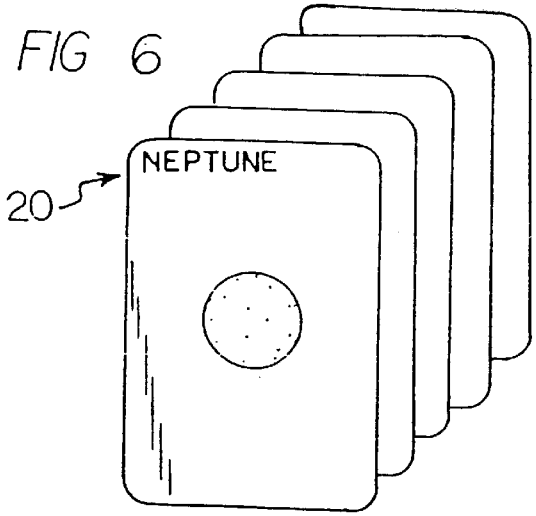
FIG. 6 is a perspective view of five Neptune cards used in the astronomy based card game.
Figure 7:
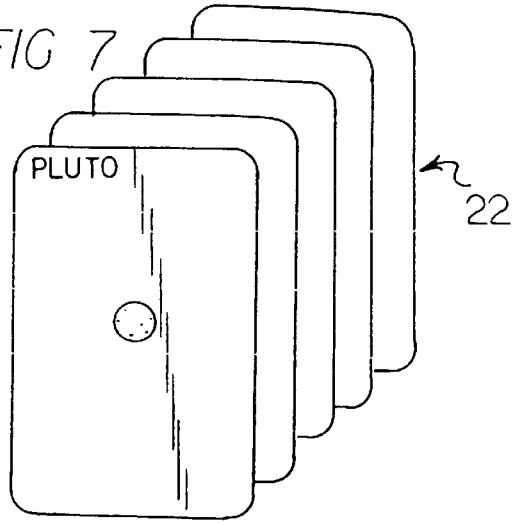
FIG. 7 is a perspective view of five Pluto cards used in the astronomy based card game.
Figure 8:
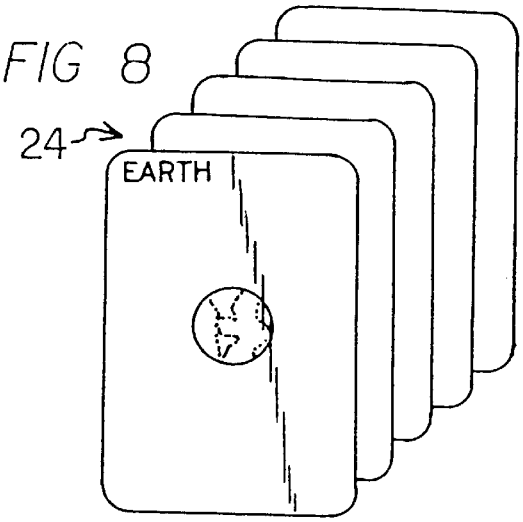
FIG. 8 is a perspective view of five Earth cards used in the astronomy based card game.
Figure 9:
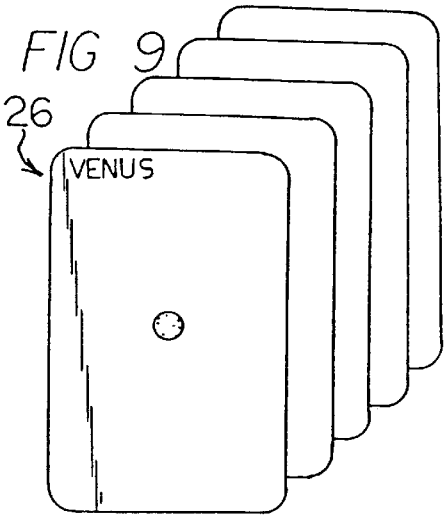
FIG. 9 is a perspective view of five Venus cards used in the astronomy based card game.
Figure 10:
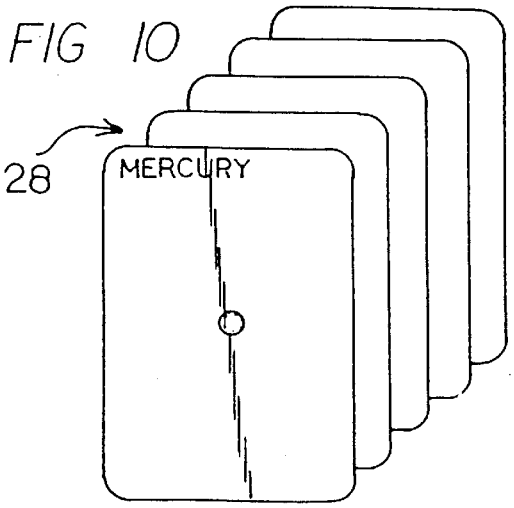
FIG. 10 is a perspective view of five Mercury cards used in the astronomy based card game.
Figure 11:
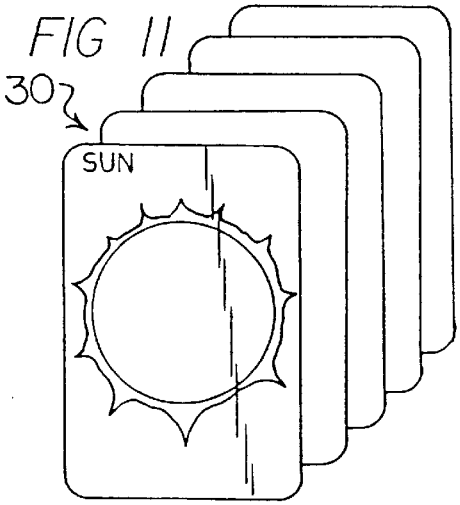
FIG. 11 is a perspective view of five Sun cards used in the astronomy based card game.
Figure 12:
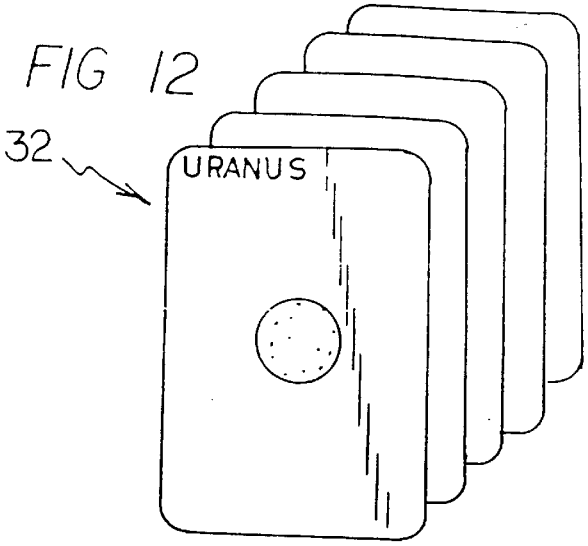
FIG. 12 is a perspective view of five Uranus cards used in the astronomy based card game.
Figure 13:
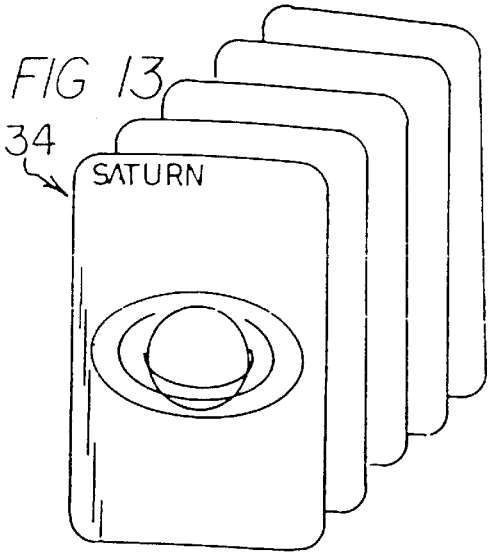
FIG. 13 is a perspective view of five Saturn cards used in the astronomy based card game.
Figure 14:
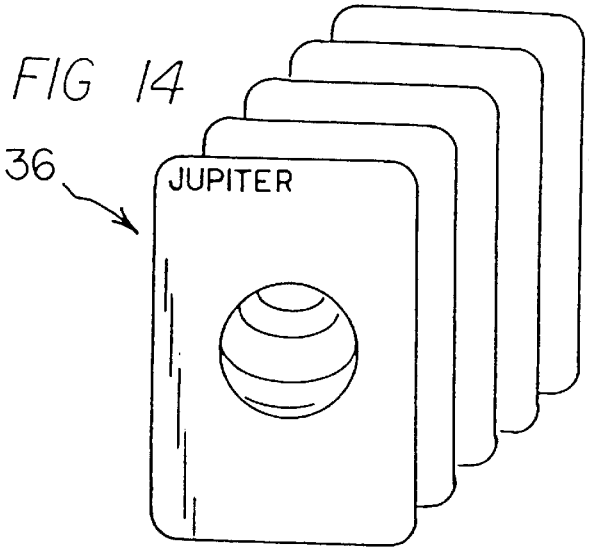
FIG. 14 is a perspective view of five Jupiter cards used in the astronomy based card game.
Figure 15:
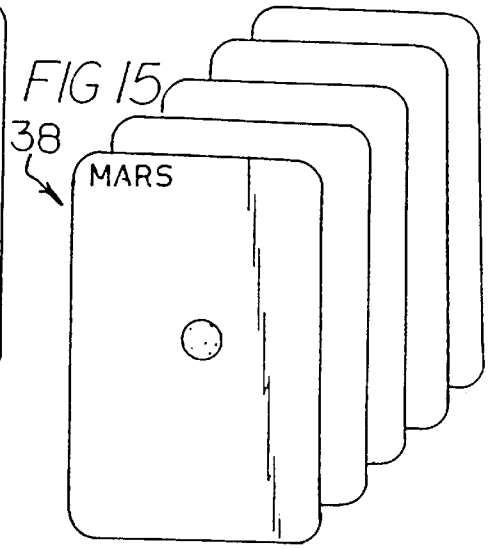
FIG. 15 is a perspective view of five Mars cards used in the astronomy based card game.
Figure 16:
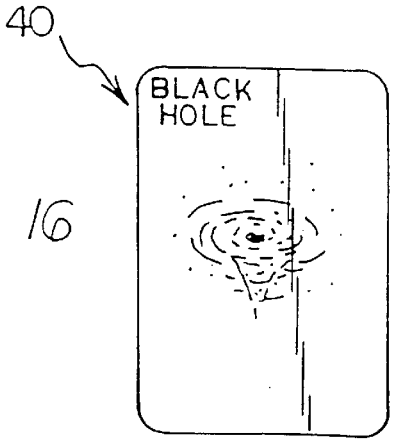
FIG. 16 is a perspective view of one black hole card used in the astronomy based card game.

Turning to FIGS. 1–16, there is shown an exemplary embodiment of the astronomy based card game of the invention. In its preferred form, the astronomy based card game includes a plurality of cards representing different astronomical bodies, where some of the cards have different color suits. The object of the game is to build a hand of a single color suit, and including a complete set of cards representing ten astronomical bodies of a solar system. In accordance with the game rules, after an initial distribution, cards are drawn from piles on the table or from another a player's hand until a winning hand is developed which contains a set of solar system cards of a single color.

The astronomical cards include four asteroid cards 12, four moon cards 14, four comet cards 16, four quasar cards 18, and ten groups of five cards each representing the Earth's Solar System.

The ten groups of cards representing the Solar System include: one group of five Neptune cards 20, one group of five Pluto cards 22, one group of five Earth cards 24, one group of five Venus cards 26, one group of five Mercury cards 28, one group of five Sun cards 30, one group of five Uranus cards 32, one group of five Saturn cards 34, one group of five Jupiter cards 36, and one group of five Mars cards 38. Each group of Solar System cards includes one card from each of five respective color suits; for example, suites of blue, green, orange, and yellow. All of the cards form a deck 15 containing sixty-seven cards in total.

The card game of the invention can be played by from two to four players. The card game can be played by persons ranging in age from about eight to adult. The object of the game is for a player to have a complete set of cards representing the Solar System, of a single suit, while discarding all other cards from one's hand. For example, a winning hand includes one Sun card, one Mercury card, one Venus card, one Earth card, one Mars card, one Jupiter card, one Saturn card, one Uranus card, one Neptune card, and one Pluto card, all from the same color suit.

The card game of the invention has a unique vocabulary which is as follows: The "banger"0 is the dealer. "Burn out" next. "Chaos"0 is the deck. An orbit is a round. To "jettison" is to discard. To "abort" is to discard without using the power of the card. "Research"0 is a hand. "Rotation" is the order of play. "Program" is research times five. After five researches, the player with the lowest score wins the game. The "jetsam" is the discard pile.

In playing the game of the invention according to its prescribed rules, research begins with a big bang when the banger slams the deck on the table and spreads the cards face down creating chaos. Then, the banger turns one card face up to begin the jetsam pile. All players choose five cards each at random from chaos. Rotation begins immediately left of the banger. Each player must pick a card from either chaos, jetsam, or if using an asteroid card, from an opponent's hand. A player does not have to discard a card while chaos remains. If chaos is all used before someone wins, then each player must either pick up from jetsam, or if using an asteroid card from an opponent's hand, or discard. A player does not have to do both unless the player wants to pick up and discard in the same play. Rotation continues to the left until one player has formed his Solar System from a single colored suit and has discarded all other cards from his hand.

In scoring the game (program), all Solar System cards are worth 100 points each. All moon, comet, asteroid, and quasar cards are worth 50 points each. The black hole card is worth 200 points. The best possible score is 0. The winning hand has 0 points. Other players must add up the values of the cards in their hands to determine their respective score. At the end of five hands (researches), the person with the lowest score is the winner of the game (program).

Certain of the cards have specific powers, allowing a player to play according to non-standard protocol, and are designated herein as wildcards. Each of the moon cards 14 allows a holder to pick up any card or cards from the discard pile (jetsam) without having to pick up all discards in the pile. Each of the asteroid cards 12 allows a holder to pick any card from an opponent's hand. Each of the comet cards 16 allows a holder to go out of turn to take the top discard card. In the event that two or more players want the same card from the discard pile, the first hand on the discard pile gets the card. The black hole card 40 allows the holder to ask any opponent for any color Solar System card. Each of the quasar cards 18 saves the holder from the black hole card 40.

To play the card game of the invention the following strategy can be employed. Save the black hole card 40, and play the black hole card 40 to take any Solar System card. Try to figure out what color solar System cards your opponents have. The bast way to play is to ask for the right color, but not too soon. Always shuffle cards in one's hand to confuse your opponents. The opponents can pick anytime with one of the asteroid cards 12. Yell "Comet" when playing a comet card. The first hand on the card gets to pick up the card when two or more players have one of the comet cards 16 and want the same discard. The Banger is the judge of any ties.

It is noted that the black hole card 40 allows a player to take one's opponent's hand momentarily to select the color from them that you asked for before you looked at their hand (unless an opponent has one of the quasar cards 18). If a player loses all of his cards as a result of the black hole card 40, the player is not out of the game. This is so because the player may get a chance to pick up the black hole card 40 and take any color Solar System card from someone else.

It is contemplated that each of the cards also have factual information about the particular astronomical body printed on the card, so that the card game of the invention will be educational as well as entertaining. Such a game can encourage an interest in the fields of astronomy and astrophysics.

The components of the astronomy based card game of the invention can be made from inexpensive and durable paper or plastic materials.

The foregoing detailed description is considered as illustrative only of the principles of the invention. Numerous modifications and changes will readily occur to those skilled in the art and therefore, it is not desired to limit the invention to the exact construction and operation shown and described. Accordingly, all suitable modifications and equivalents falling within the broad scope of the subject matter described above may be resorted to in carrying out the present invention.

What is claimed is:

1. A method of playing an astronomy-based card game, comprising:

(a) providing a deck of cards comprising a plurality of suits, each suit comprising cards representing a set of astronomical bodies defining a solar system, each suit comprising one Sun card, one Mercury card, one Venus card, one Earth card, one Mars card, one Jupiter card, one Saturn card, one Neptune card, one Uranus card and one Pluto card;

(b) distributing cards from the deck to a plurality of players, whereby each said player randomly selects a plurality of cards from said deck of cards; and (c) playing the cards according to prescribed rules until one of the plurality of players assembles a hand of cards including a complete suit of cards representing a set of astronomical bodies;

wherein said step of playing the cards according to prescribed rules comprises each player in turn picking a card from a selected one of:

(i) unplayed cards remaining in said deck, (ii) a discard pile of cards, or (iii) an opposing player's hand.

2. A method of playing an astronomy-based card game, comprising:

(a) providing a deck of cards comprising a plurality of suits and at least one wildcard, each suit comprising cards representing a set of astronomical bodies;

(b) distributing cards from the deck to a plurality of players; and (c) playing the cards according to prescribed rules until one of the plurality of players assembles a hand of cards including a complete suit of cards representing a set of astronomical bodies;

wherein said step of playing the cards according to prescribed rules comprises permitting a player of each said wildcard to play according to a non-standard protocol, whereby a player of said wildcard is permitted to pick a selected card from an opposing player's hand.

3. The method of claim 1, further comprising providing a Black Hole wildcard, and wherein said step of playing the cards according to prescribed rules comprises permitting a player of said Black Hole wildcard to take cards of a selected suit from an opposing player's hand.

4. The method of claim 3, further comprising providing a Quasar wildcard, and wherein said step of playing the cards according to prescribed rules comprises permitting a player of said Quasar wildcard to prevent the player of said Black Hole wildcard from taking cards from the hand of the player of said Quasar wildcard.

* * * * *